US005618103A

United States Patent [19]

Fussell

[11] Patent Number: 5,618,103

[45] Date of Patent: Apr. 8, 1997

[54] MOTORIZED AND LIGHTED DECORATIVE ORNAMENTS

[76] Inventor: David A. Fussell, 9115 June La., Summer Island, St. Agustine, Fla. 32086

[21] Appl. No.: 318,129

[22] Filed: Oct. 5, 1994

[51] Int. Cl.[6] ..... F21S 13/00

[52] U.S. Cl. ..... 362/386; 362/396; 362/806; 315/185 S

[58] Field of Search ..... 362/35, 122, 123, 362/386, 396, 806, 286; 315/74, 65, 185 S, 185 R

[56] References Cited

U.S. PATENT DOCUMENTS 2,485,460 10/1949 Rocco ..... 362/123

4,980,608 12/1990 Morrison ..... 315/185 S 4,989,120 1/1991 Davis et al. ..... 362/806

*Primary Examiner*—Y. My Quach

*Attorney, Agent, or Firm*—Hinkle & Associates, P.C.

[57] ABSTRACT

A rotative and lightable ornament apparatus has a miniature electrical input line (1) in electrical communication with a circuit that is branched to lines leading to at least one miniature electrical motor (3) and to at least one miniature electrical outlet (2) for optional lighting and electrical rotation. The input line can be a Christmas tree light plug (6) and the miniature outlet for optional lighting and electrical actuation can be a miniature light socket (8) for a miniature light (9), flasher (52), or other miniature lamps. Circuitry for branching from the input line can include a plurality of electrically connected zener diodes (28) to offset pulsating electrical effects of a flasher on the miniature motor.

9 Claims, 6 Drawing Sheets

FIG. 3
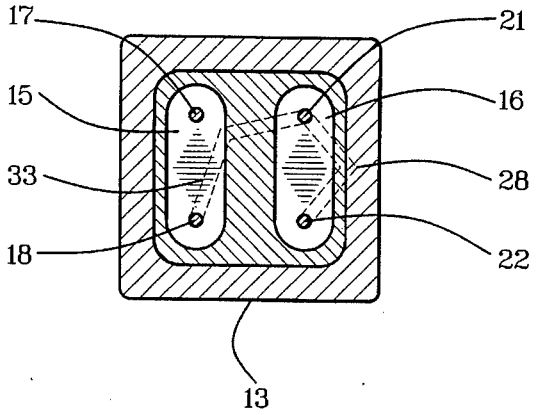
FIG. 4
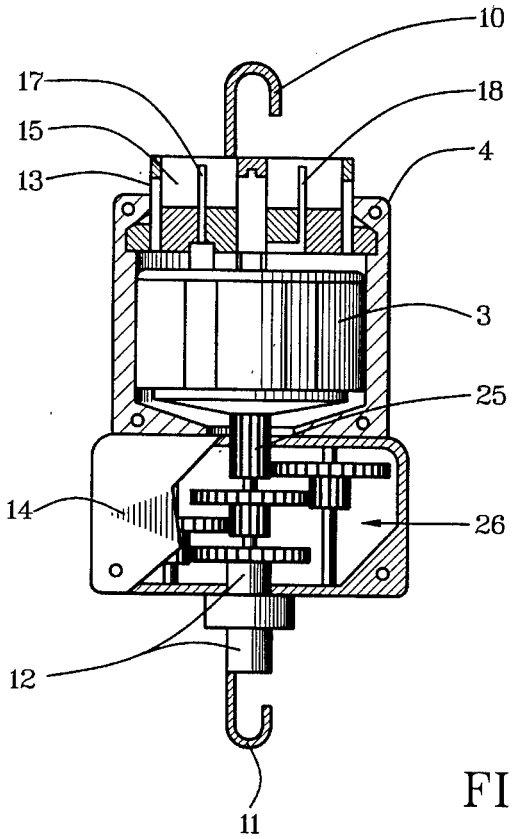
FIG. 5
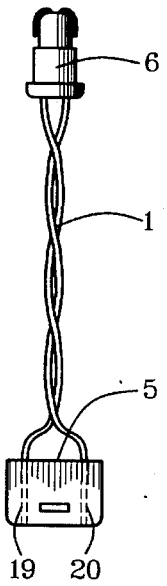
FIG. 6
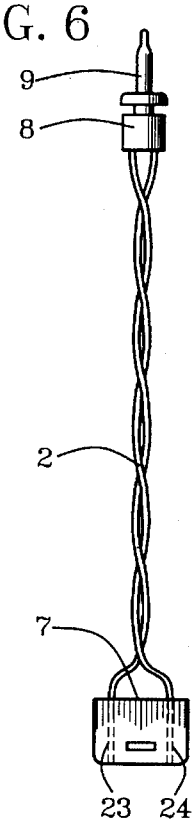
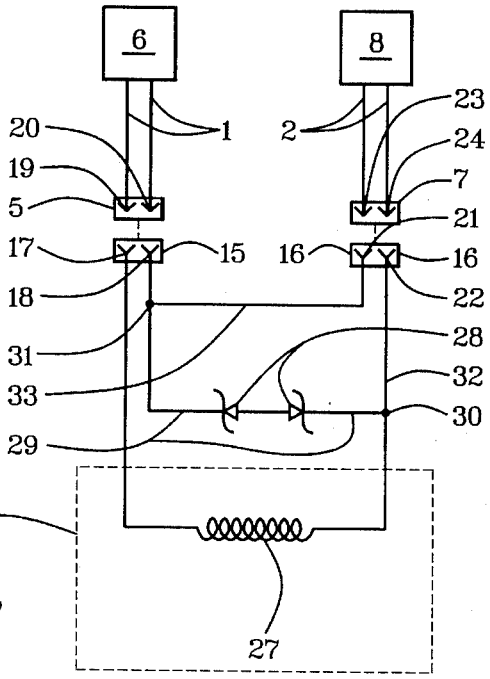
FIG. 7

MOTORIZED AND LIGHTED DECORATIVE ORNAMENTS

BACKGROUND OF THE INVENTION

I. Field of the Invention

The present invention relates generally to the field of rotating and lighting decorative ornaments.

II. Description of the Prior Art

Ornaments have been made to be rotative as described in relation to U.S. Pat. No. 4,980,608 granted to Morrison. But that has left the ornaments less attractive than though they were lighted. Providing such small and light items as Christmas tree ornaments and other types of miniature ornaments with both rotating and lighting means, however, requires further innovation not taught in the Morrison patent. Further, the Morrison patent was limited to use in a predetermined plurality of lamp sockets in a Christmas tree light cord.

SUMMARY OF THE INVENTION

In accordance with the present invention, it is contemplated that a primary objective of this invention, therefore, is to provide means for both rotation and lighting of ornaments and other items having similar characteristics.

Another objective is to provide a means for hanging lighted rotative ornaments from Christmas trees and other objects.

Another objective is to provide a means for operating lighted rotative ornaments from a light socket of a Christmas tree light wire.

Another objective is to provide a means for attaching lighted rotative ornaments to tops of Christmas trees.

Another objective is to provide a means for standing lighted rotative ornaments on tops of furniture items.

Yet another objective is to provide lighted, rotative and mechanically operative ornaments for a wide variety of decorative uses.

This invention accomplishes the above and other objectives with a miniature electrical input line in electrical communication with a circuit that is branched to lines leading to at least one miniature motor and to at least one miniature outlet for optional lighting and electrical actuation. The input line can be a Christmas tree light plug and the miniature outlet for optional lighting and electrical actuation can be a miniature light socket for a midget light, flasher light, L.E.D. lamp, or an additional miniature rotative or linear electrical motor. Circuitry for branching from the input line can include a plurality of electrically connected zener diodes to offset pulsation of electrical current from use of a flasher in a same line.

Other objects, advantages and capabilities of the invention will become apparent from the following description taken in conjunction with the accompanying drawings showing preferred embodiments of the invention.

BRIEF DESCRIPTION OF THE DRAWINGS

FIG. 3 is a top view of a plug section;

FIG. 4 is a cutaway front view of a motor section and gear section;

FIG. 5 is an elevation view of an electrical inlet;

FIG. 6 is an elevation view of an electrical outlet;

FIG. 7 is a circuit diagram;

DESCRIPTION OF THE PREFERRED EMBODIMENTS

Figure 1:
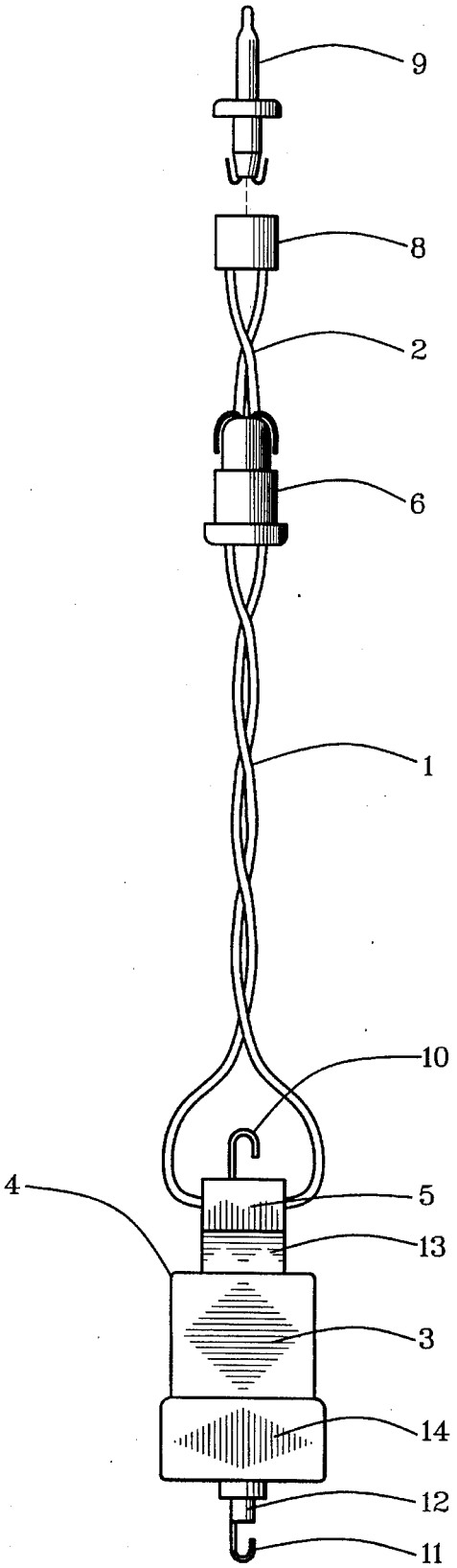
FIG. 1 is a front elevation view.
Figure 2:
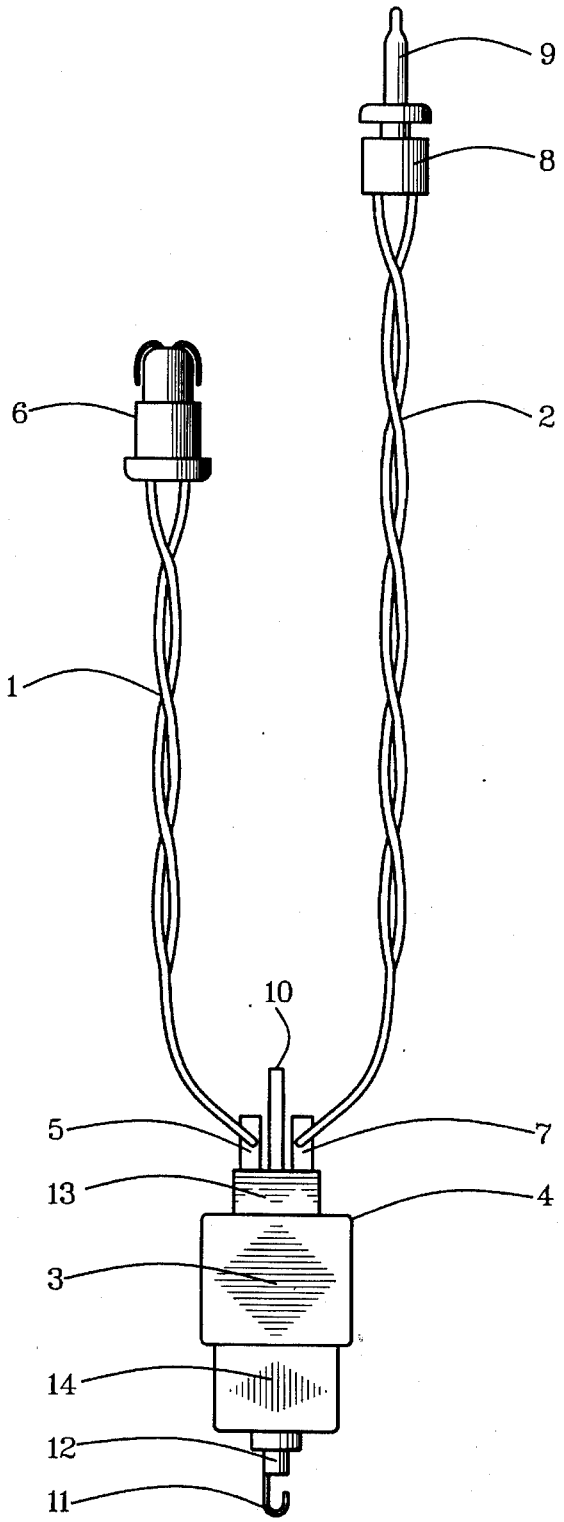
FIG. 2 is a side elevation view.

Referring to the drawings wherein like reference numerals designate corresponding parts throughout the several figures, reference is made first to FIGS. 1–2. An electrical inlet 1, an electrical outlet 2 and an electrical motor 3 are attached to an ornament base 4. The ornament base 4 can be a case in which a proximal end of the electrical outlet 2 and the electrical motor 3 are positioned. The electrical inlet 1 can have an inlet plug 5 at a proximal end and a source plug 6 at a distal end. The electrical outlet 2 can have an outlet plug 7 at a proximal end and a miniature light socket 8 for a variety of miniature lights 9 at a distal end. As a base for holding desired ornaments, the ornament base 4 has a base hook 10 with which the ornament base 4 is suspended and a rotary hook 11 from which desired ornaments are suspended from an output shaft 12 of the electrical motor 3.

The electrical motor 3 and the miniature light 9 are sized and structured for operation from a miniature electrical line such as a Christmas tree light cord. Both the electrical motor 3 for rotating ornaments and the miniature light 9, therefore, are operable from a single miniature electrical outlet such as a light socket in a Christmas tree light cord. The inlet plug 5 and the outlet plug 7 fit into separate portions of a plug section 13.

The width of the motor 3 is the same in a front view for FIG. 1 as in a side view for FIG. 2 to accommodate a cylindrical shape. A gear section 14 is wider in FIG. 1 than in FIG. 2 for accommodating reduction gearing that can be employed. The electrical motor 3 can have either a cubical case as shown or a cylindrical case. The output shaft 12 is extendible from the gear section 14.

Reference is made now to FIGS. 3–7. The plug section 13 has an inlet socket 15 and an outlet socket 16 as illustrated in FIG. 3. The inlet socket 15 has a motor pole 17 and a motor-return pole 18. As shown in FIG. 5, the inlet plug 5 has an inlet conductor 10 and an inlet-return conductor 20, depicted with dashed lines, which communicate electrically with the motor pole 17 and the motor-return pole 18 respectively. The outlet socket 16 has an outlet pole 21 and an outlet-return pole 22. As shown in FIG. 6, the outlet plug 7 has an outlet conductor 23 and an outlet-return conductor 24, depicted also with dashed lines, which communicate electrically with the outlet pole 21 and the outlet-return pole 22 respectively. The motor pole 17 and the motor-return pole 18 are shown in the cutaway illustration of FIG. 4.

In FIG. 4, a motor shaft 25 is in shaft-drive relationship with reduction gearing 26 from which the output shaft 12 is extended. The reduction gearing 26 can be a conventional series of small-to-large-diameter gears as shown.

Circuitry for selection of current distribution to a motor coil 27 of the motor 3 and to the light 9 from the light socket 8 is illustrated in FIGS. 3 and 7. A current distributor can be a line furcation with branches to as many load points as sustainable by an input line. When a flasher, such as some form of capacitor in a current path, is used for intermittent surges of current at a load point, however, current to one or more other load points of the same line furcation also fluctuates. To provide even flow of current for such use of a flasher, a pair of two zener diodes are positioned in a return line from a load point for which non-fluctuating current is desired.

Accordingly, two zener diodes 28 are positioned in series connection in a motor-return line 29 intermediate the motor coil and a first circuit bifurcation 30 of the motor-return line 29 and a second circuit bifurcation 31 of the motor-return line 29. A light-return line 32 is in electrical communication from the first circuit bifurcation 30 to the outlet-return pole 22. A light-input line 33 is in electrical communication from the second circuit bifurcation 31 to the outlet pole 21. The light-input line 33 can be a form of electrical jumper. This provides suitable circuitry for use of the electrical outlet 2 with or without a flasher means in the miniature light socket 8 or elsewhere intermediate the miniature light 9 and the electrical outlet 2.

Figure 8:
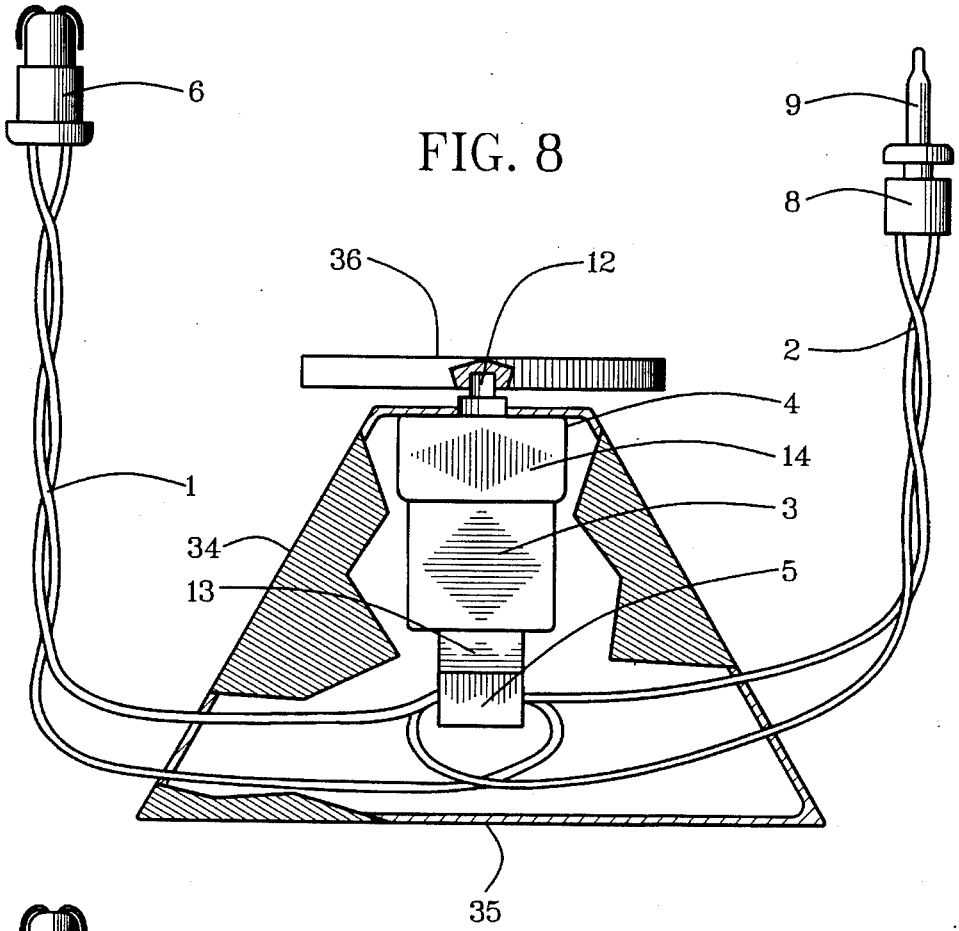
FIG. 8 is a cutaway elevation view of an upright-positioning base for an upright-positioning embodiment with a rotative base for rotating ornaments without simultaneous rotation of the electrical outlet.
Figure 9:
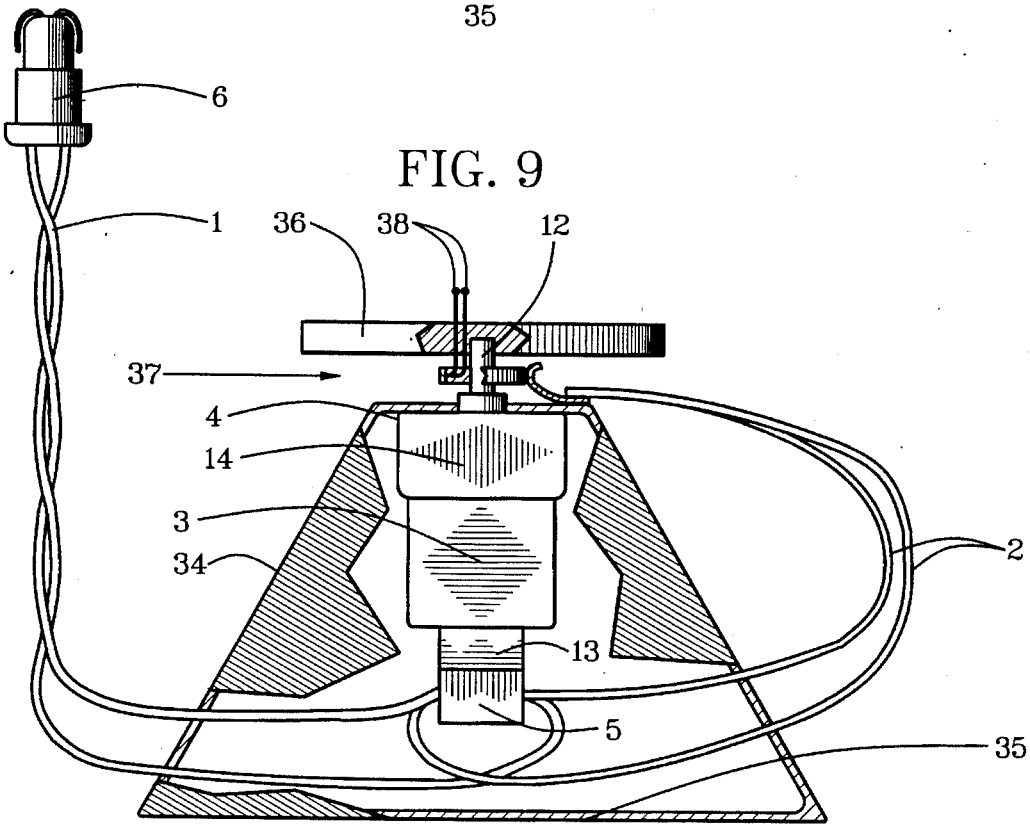
FIG. 9 is the FIG. 8 illustration with a rotative connection for providing rotation of electrical lines and rotation of an ornament on the rotative base simultaneously.

Referring to FIGS. 8–9, the ornament base 4 can have an upright-positioning base 34 with a bottom surface 35 that is perpendicular to an axis of the output shaft 12. This allows positioning the ornament base 4 on a flat surface such as a tabletop, window sill or shelf. A rotative ornament holder 36 can be attached to the output shaft 12 to hold ornaments in an upright position. The electrical outlet 2 can be extended from the upright-positioning base 34 to desired proximity to the rotative ornament holder 36 and desired ornamentation positioned thereon.

A rotative electrical connection 37 can be provided in the electrical outlet 2 with connection terminals 38 on a top side of the rotative ornament holder 36 as shown in FIG. 9. This allows positioning of a miniature light 9 in an ornament positioned on the rotative ornament holder 36.

Figure 10:
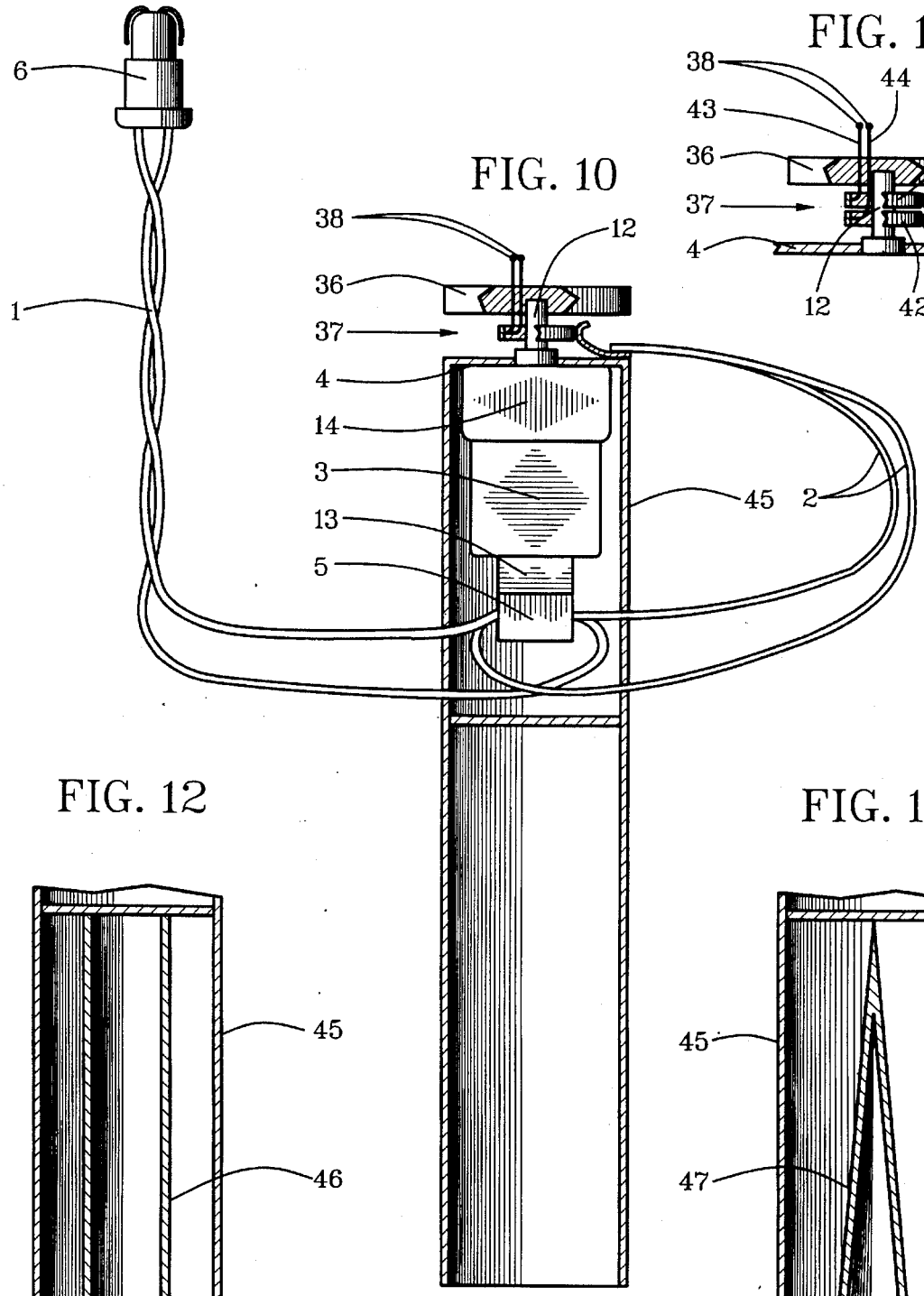
FIG. 10 is a cutaway elevation view of an upright-positioning base with a sleeve for positioning on vertical projections.
Figure 11:
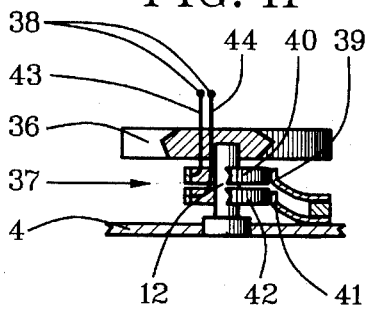
FIG. 11 is a cutaway sectional view of a rotative connection with inlet and outlet connections.

Referring to FIGS. 9–11, the rotative electrical connection 37 can be any means for transmitting electrical current from a stationary position to a rotating position. In FIG. 11, a stationary input conductor 39 is in electrical communication with a rotative input conductor 40 and a stationary return conductor 41 is in electrical communication with a rotative return conductor 42. Then an input lead 43 can be routed from the rotative input conductor 40 to an appropriate connection terminal 38. Likewise, a return lead 44 is routed from the rotative return conductor 42 to a remaining one of the connection terminals 38.

Figure 12:
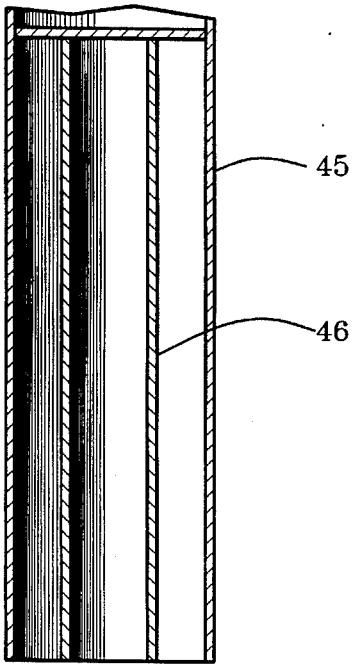
FIG. 12 is a cutaway sectional view of a cylindrical insert to receive smaller vertical projections with the sleeve illustrated in FIG. 10.
Figure 13:
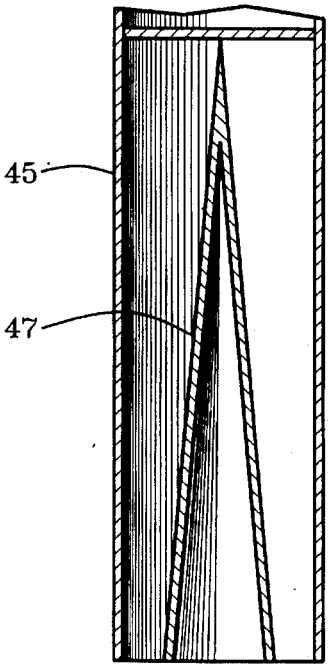
FIG. 13 is a cutaway sectional view of a conical insert for the FIG. 10 illustration to receive tapered vertical projections.

As shown in FIGS. 10 and 12–13, a case comprising the ornament base 4 can have an upright-positioning sleeve 45 with an internal periphery parallel to an axis of the output shaft 12. This allows positioning of upright-projecting items into the upright-positioning sleeve for holding the base 4 and desired ornamentation positioned on the rotative ornament holder 36. Cylindrical inserts 46 shown in FIG. 12 and conical inserts 47 shown in FIG. 13 can be positioned inside of upright-positioning sleeves 45 for positioning on smaller upright-projecting items. Either of the inserts 46 and 47 can be sized and shaped for fitting on an outside of a top of a Christmas tree.

Figure 14:
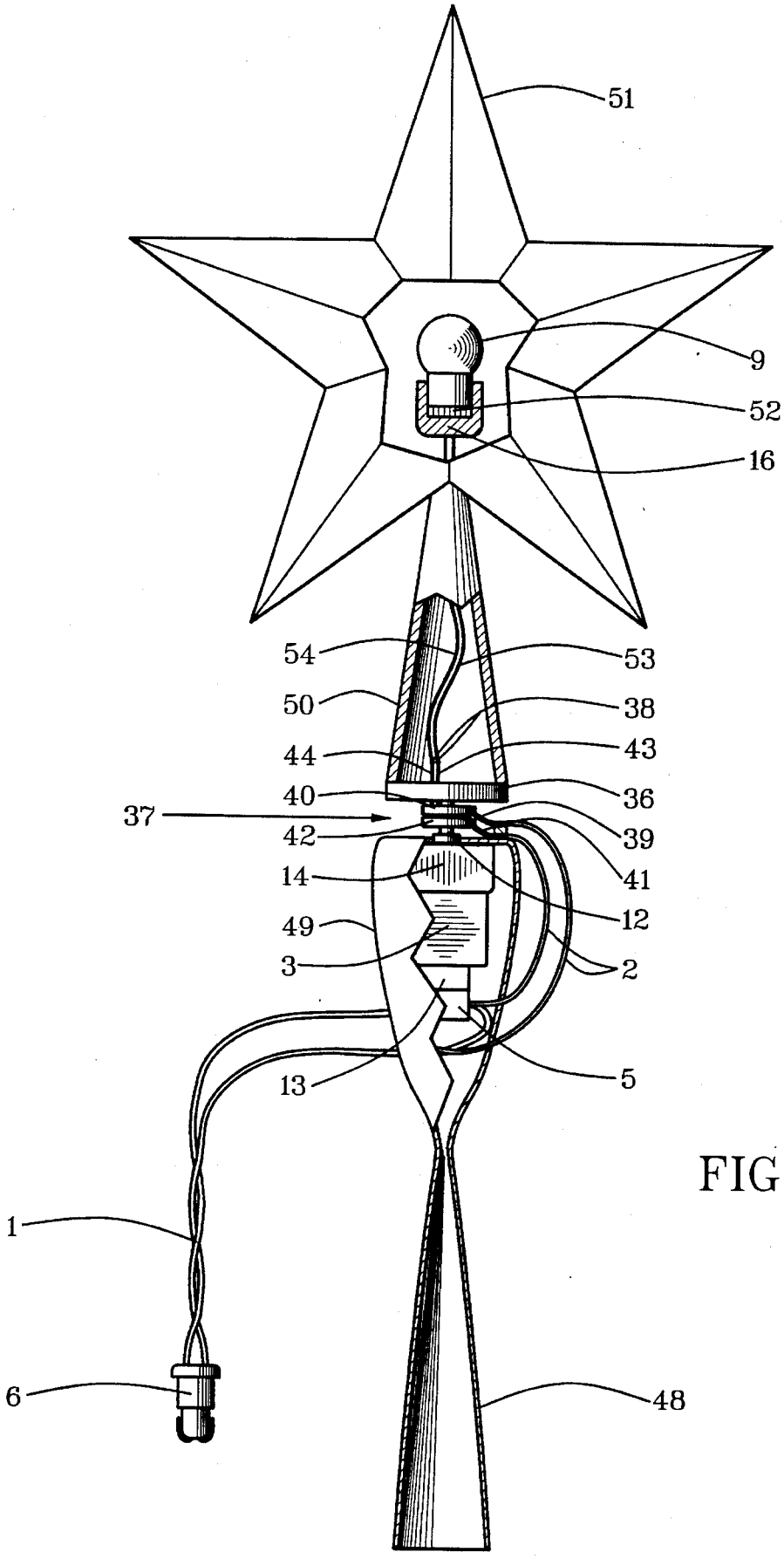
FIG. 14 is a partial cutaway elevation view of an embodiment with a conical skirt, a conical case, a conical ornament pillar, an ornament, a flasher, a light and a rotative connection that is suited particularly for positioning lighted and rotative ornaments on tops of Christmas trees and lighting them with a Christmas tree light cord.

As depicted in FIG. 14, a conical skirt 48 can be attached to a bottom of a conical base 49 to provide clean lines and low weight for adaptation to various types of projection-fitting. An ornament pillar 50 can be extended vertically from the rotative ornament holder 36 for holding desired ornaments 51 such as represented by a star. The ornament pillar 50 can be conical or other desired shape for particular ornaments. The ornament pillar 50 also could comprise part or all of an ornament 51.

Shown in the cutaway of the ornament 51 is a flasher 52 in an outlet socket 16. It is positioned between electrical terminals on the miniature light 9 and the outlet socket 16 to which ornament input line 53 and ornament return line 54 are connected electrically. The ornament input line 53 and the ornament return line 54 are connected to connection terminals 38 of the rotative electrical connection 37 as described in relation to FIG. 11. A circuitry with zener diodes 28 in the plug section 13, as described in relation to FIGS. 3–7, is assumed for use of the flasher 52.

Ornaments 51 can be partially or totally translucent or transparent or they can have open spaces to emit light from the miniature light 9 as an ornament 51 is rotated. A wide variety of very attractive ornamentation can be designed to employ these physical features.

Figure 15:
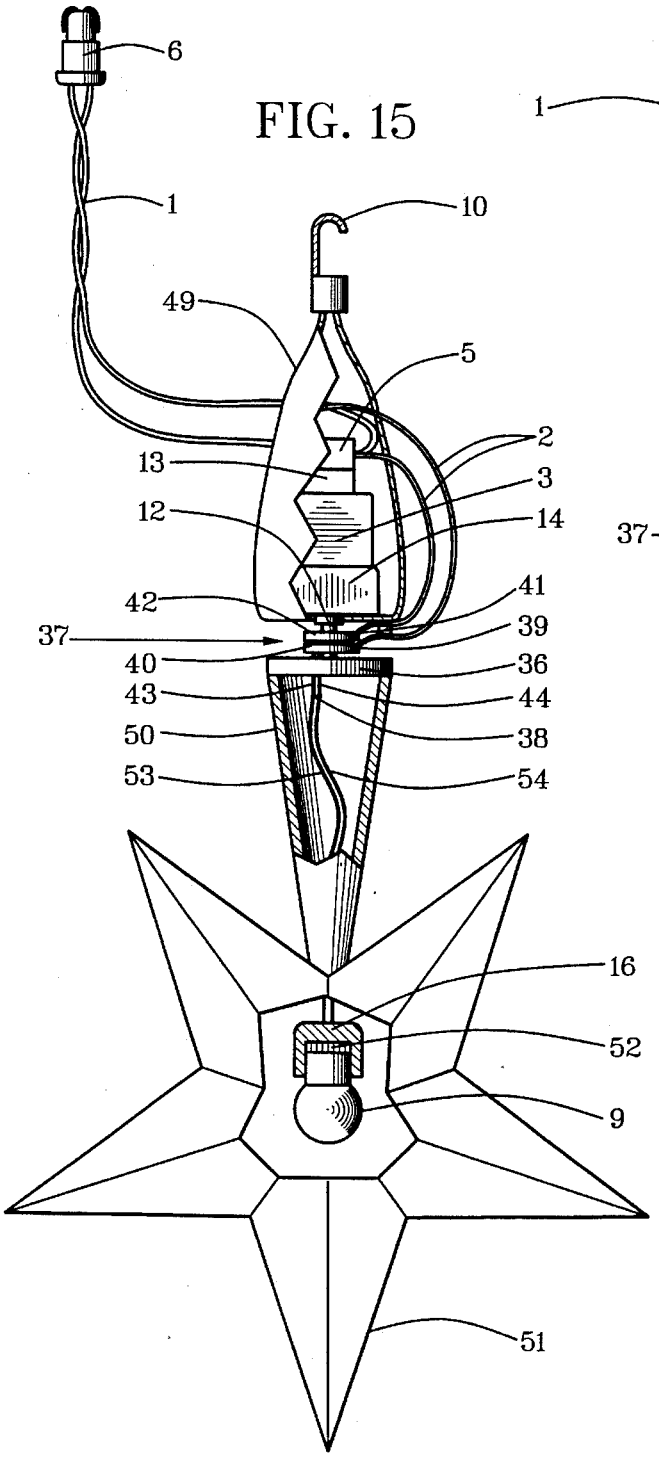
FIG. 15 is a partial cutaway elevation view of an inverted embodiment of the FIG. 14 illustration for hanging lighted rotative ornaments from Christmas trees or other objects.
Figure 16:
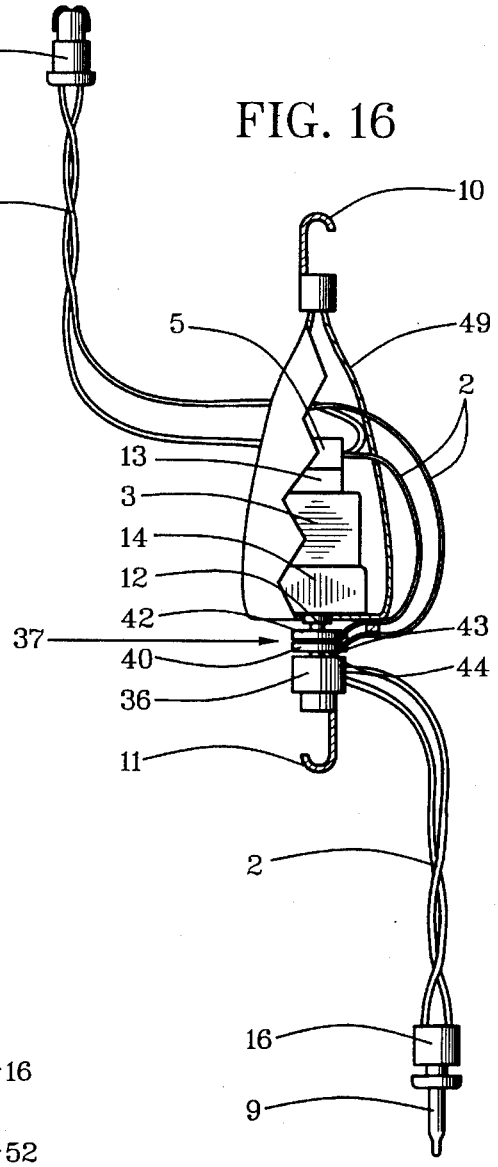
FIG. 16 is a partial cutaway elevation view of a hanging embodiment with a rotative light that can be fixed in desired proximity to a hanging ornament that is rotative together with the hanging ornament.

Reference is made finally to FIGS. 15–16. A base hook 10 can be positioned on the conical base 49 in an inverted attitude relative to the FIG. 14 embodiment. These are hanging embodiments with outlet sockets 16 that rotate with a desired ornament 51. The desired ornament 51 can be positioned on an ornament pillar 50 in hanging attitude as depicted in FIG. 15 or hung from a rotary hook 11 shown in FIG. 16. An embodiment in which the outlet socket 16 does not rotate with a desired ornament 51 is described in relation to FIGS. 1–2.

As shown in FIG. 16, the rotary hook 11 can be attached to a rotative ornament holder 36 with an appropriately smaller diameter than for ornament pillars 50 described in relation to FIGS. 14–15 or for other rotative ornament holders described in relation to FIGS. 8–11. Also, the electrical outlet 2 can be connected electrically to connection terminals 38 from the input lead 43 and the return lead 44, as described in relation to FIGS. 11 and 14, inside of the rotative ornament holder 36.

Various modifications may be made of the invention without departing from the scope thereof and it is desired, therefore, that only such limitations shall be placed thereon as are imposed by the prior art and which are set forth in the appended claims.

What is claimed is:

1. A rotative and lightable ornament apparatus comprising:

at least one electrical outlet and at least one electrical motor attached to an ornament base, an electrical input in electrical communication with a current distributing means that is in electrical communication from the electrical input to the electrical motor and to the electrical outlet selectively, the current distributing means being a first and a second circuit bifurcation in electrical communication from the electrical input to the electrical motor and to at least one electrical outlet connection, and the electrical outlet connected to the at least one electrical outlet connection being sized and shaped to convey electrical current from the current distributing means to at least one miniature electrical light.

2. A rotative and lightable ornament apparatus as claimed in claim 1 and further comprising: two zener diodes in series connection intermediate the first circuit bifurcation and the second circuit bifurcation in a motor-return line from a coil of the electrical motor, a light-return line in electrical communication from the first circuit bifurcation to an outlet-return pole of the outlet, and a light-input line in electrical communication from the second circuit bifurcation to an outlet pole of the outlet.

3. A rotative and lightable ornament apparatus as claimed in claim 1 wherein the ornament base is a case on which the electrical outlet and the electrical motor are positioned.

4. A rotative and lightable ornament apparatus as claimed in claim 3 and further comprising: a hanger means on an output shaft of the electrical motor positioned in the ornament base.

5. A rotative and lightable ornament apparatus as claimed in claim 4 wherein the hanger means is a rotary hook that is sized and shaped for hanging ornaments from the electrical motor for rotation.

6. A rotative and lightable ornament apparatus as claimed in claim 4 and further comprising a hanger means positioned on the ornament base.

7. A rotative and lightable ornament apparatus as claimed in claim 6 wherein the hanger means positioned on the ornament base is a base hook that is sized and shaped for hanging the ornament base from desired objects.

8. A rotative and lightable ornament apparatus as claimed in claim 3 and further comprising: a hanger means positioned on the ornament base.

9. A rotative and lightable ornament apparatus as claimed in claim 8 wherein the hanger means is a base hook that is sized and shaped for hanging the ornament base from desired objects.

* * * * *